US006676482B2

(12) United States Patent
Bibby, Jr. et al.

(10) Patent No.: US 6,676,482 B2
(45) Date of Patent: Jan. 13, 2004

(54) LEARNING METHOD AND APPARATUS FOR PREDICTIVE DETERMINATION OF ENDPOINT DURING CHEMICAL MECHANICAL PLANARIZATION USING SPARSE SAMPLING

(75) Inventors: Thomas F. A. Bibby, Jr., St. Albans, VT (US); John A. Adams, Escondido, CA (US)

(73) Assignee: SpeedFam-IPEC Corporation, Chandler, AZ (US)

( * ) Notice: Subject to any disclaimer, the term of this patent is extended or adjusted under 35 U.S.C. 154(b) by 188 days.

(21) Appl. No.: 09/839,631

(22) Filed: Apr. 20, 2001

(65) Prior Publication Data

US 2002/0155789 A1 Oct. 24, 2002

(51) Int. Cl.[7] ..... B24B 49/17
(52) U.S. Cl. ..... 451/6; 451/41
(58) Field of Search ..... 451/5, 6, 8, 41, 451/288, 287

(56) References Cited

U.S. PATENT DOCUMENTS

| | | | | |
|---|---|---|---|---|
| 4,611,919 A | | 9/1986 | Brooks, Jr. et al. | |
| 4,953,982 A | | 9/1990 | Ebbing et al. | |
| 4,972,072 A | | 11/1990 | Hauser et al. | |
| 5,131,752 A | | 7/1992 | Yu et al. | |
| 5,151,584 A | | 9/1992 | Ebbing et al. | |
| 5,190,614 A | | 3/1993 | Leach et al. | |
| 5,222,329 A | * | 6/1993 | Yu | 451/10 |
| 5,245,794 A | * | 9/1993 | Salugsugan | 451/8 |
| 5,413,941 A | | 5/1995 | Koos et al. | |
| 5,433,651 A | | 7/1995 | Lustig et al. | |
| 5,499,733 A | | 3/1996 | Litvak | |
| 5,552,327 A | | 9/1996 | Bachmann et al. | |
| 5,658,418 A | | 8/1997 | Coronel et al. | |
| 5,659,492 A | * | 8/1997 | Li et al. | 451/41 |
| 5,872,633 A | | 2/1999 | Holzapfel et al. | |
| 5,910,846 A | | 6/1999 | Sandhu | |
| 6,060,328 A | | 5/2000 | En et al. | |
| 6,061,137 A | | 5/2000 | Dauksher et al. | |
| 6,074,517 A | | 6/2000 | Taravade | |
| 6,081,334 A | | 6/2000 | Grimbergen et al. | |
| 6,106,662 A | | 8/2000 | Bibby, Jr. et al. | |
| 6,108,092 A | | 8/2000 | Sandhu | |
| 6,110,752 A | | 8/2000 | Litvak | |
| 6,153,116 A | | 11/2000 | Yang et al. | |
| 6,276,987 B1 | * | 8/2001 | Li et al. | 451/5 |

FOREIGN PATENT DOCUMENTS

WO WO 98/05066 2/1998

* cited by examiner

*Primary Examiner*—Robert A. Rose
(74) *Attorney, Agent, or Firm*—Snell & Wilmer, L.L.P.

(57) ABSTRACT

A method and apparatus to generate an endpoint signal to control the polishing of thin films on a semiconductor wafer surface includes a through-bore in a polish pad assembly, a light source, a fiber optic cable, a light sensor, and a computer. The light source provides light within a predetermined bandwidth, the fiber optic cable propagates the light through the through-bore opening to illuminate the surface as the pad assembly orbits, and the light sensor receives reflected light from the surface through the fiber optic cable and generates reflected spectral data. The computer receives the reflected spectral data and calculates an endpoint signal by comparing the reflected spectral data with previously collected spectral reference data, calculating a trigger time based on the comparison, and predicting the endpoint time utilizing the trigger time.

8 Claims, 3 Drawing Sheets

LEARNING METHOD AND APPARATUS FOR PREDICTIVE DETERMINATION OF ENDPOINT DURING CHEMICAL MECHANICAL PLANARIZATION USING SPARSE SAMPLING

FIELD OF THE INVENTION

The present invention relates to chemical mechanical planarization (CMP), and more particularly, to optical endpoint detection during a CMP process, and specifically to prediction of that endpoint.

BACKGROUND

Chemical mechanical planarization (CMP) has emerged as a crucial semiconductor technology, particularly for devices with critical dimensions smaller than 0.5 micron. One important aspect of CMP is endpoint detection (EPD), i.e., determining during a polishing process when to terminate the polishing process.

Many users prefer EPD systems that are "in situ EPD systems", which provide EPD during the polishing process. Numerous in situ EPD methods have been proposed, but few have been successfully demonstrated in a manufacturing environment and even fewer have proved sufficiently robust for routine production use.

One group of prior art in situ EPD techniques involves the electrical measurement of changes in the capacitance, the impedance, or the conductivity of the wafer and calculating the endpoint based on an analysis of this data. To date, these particular electrically based approaches to EPD do not appear to be commercially viable.

Another electrical approach that has proved production worthy is to sense changes in the friction between the wafer being polished and the polish pad. Such measurements are done by sensing changes in the motor current. These systems use a global approach, i.e., the measured signal assesses the entire wafer surface. Thus, these systems do not obtain specific data about localized regions. Further, this method works best for EPD for metal CMP because of the dissimilar coefficient of friction between the polish pad and the layers of metal film stacks such as a tungsten-titanium nitride-titanium film stack versus the coefficient of friction between the polish pad and the dielectric underneath the metal. However, with advanced interconnection conductors, such as copper (Cu), the associated barrier metals, e.g., tantalum or tantalum nitride, may have a coefficient of friction that is similar to the underlying dielectric. The motor current approach relies on detecting the copper-tantalum nitride transition, then adding an overpolish time. Intrinsic process variation in the thickness and composition of the remaining film stack layer mean that the final endpoint trigger time may be less precise than is desirable.

Another group of methods uses an acoustic approach. In a first acoustic approach, an acoustic transducer generates an acoustic signal that propagates through the surface layer(s) of the wafer being polished. Some reflection occurs at the interface between the layers, and a sensor positioned to detect the reflected signals can be used to determine the thickness of the topmost layer as it is polished. In a second acoustic approach, an acoustical sensor is used to detect the acoustic signals generated during CMP. Such signals have spectral and amplitude content that evolves during the course of the polish cycle. However, to date there has been no commercially available in situ endpoint detection system using acoustic methods to determine endpoint.

Finally, the present invention falls within the group of optical EPD systems. An optical EPD system is disclosed in U.S. Pat. No. 5,433,651 to Lustig et al. in which light transmitted through a window in the platen of a rotating CMP tool and reflected back through the window to a detector is used to sense changes in a reflected optical signal. However, the window complicates the CMP process because it presents to the wafer an inhomogeneity in the polish pad. Such a region can also accumulate slurry and polish debris that can cause scratches and other defects.

Another approach is of the type disclosed in European application EP 0 824 995 A1, which uses a transparent window in the actual polish pad itself. A similar approach for rotational polishers is of the type disclosed in European application EP 0 738 561 A1, in which a pad with an optical window is used for EPD. In both of these approaches, various means for implementing a transparent window in a pad are discussed, but making measurements without a window was not considered. The methods and apparatuses disclosed in these patents require sensors to indicate the presences of a wafer in the field of view. Furthermore, integration times for data acquisition are constrained to the amount of time the window in the pad is under the wafer.

In another type of approach, the carrier is positioned on the edge of the platen so as to expose a portion of the wafer. A fiber optic based apparatus is used to direct light at the surface of the wafer, and spectral reflectance methods are used to analyze the signal. The drawback of this approach is that the process must be interrupted in order to position the wafer in such a way as to allow the optical signal to be gathered. In so doing, with the wafer positioned over the edge of the platen, the wafer is subjected to edge effects associated with the edge of the polish pad going across the wafer while the remaining portion of the wafer is completely exposed. An example of this type of approach is described in PCT application WO 98/05066.

In another approach, the wafer is lifted off of the pad a small amount, and a light beam is directed between the wafer and the slurry-coated pad. The light beam is incident at a small angle so that multiple reflections occur. The irregular topography on the wafer causes scattering, but if sufficient polishing is done prior to raising the carrier, then the wafer surface will be essentially flat and there will be very little scattering due to the topography on the wafer. An example of this type of approach is disclosed in U.S. Pat. No. 5,413,941. The difficulty with this type of approach is that the normal process cycle must be interrupted to make the measurement.

A further approach entails monitoring absorption of particular wavelengths in the infrared spectrum of a beam incident upon the backside of a wafer being polished so that the beam passes through the wafer from the nonpolished side of the wafer. Changes in the absorption within narrow, well defined spectral windows correspond to changing thickness of specific types of films. This approach has the disadvantage that, as multiple metal layers are added to the wafer, the sensitivity of the signal decreases rapidly. One example of this type of approach is disclosed in U.S. Pat. No. 5,643,046.

SUMMARY

A method is provided for use with a tool for polishing thin films on a semiconductor wafer surface that predicts an endpoint of a polishing process. In one embodiment, the method utilizes an apparatus that includes a polish pad having a through-hole, which is in optical communication with a light source through a fiber optic cable assembly. The apparatus also includes a light sensor, and a computer. The light source provides light within a predetermined bandwidth. The fiber optic cable propagates the light through the through-hole to illuminate the wafer surface during the polishing process. The light sensor receives reflected light from the surface through the fiber optic cable and generates data corresponding to the spectrum of the reflected light. The computer receives the reflected spectral data (the "reflected signal") and generates a signal as a function of the reflected spectrum (the "reflectance spectrum", i.e., a gathered reflectance spectrum). The generated signal is then compared to spectra taken from other similar wafers (the "reference spectrum") processed prior to the current wafer. The comparison involves using any of many available methods to generate a difference between the reflected signal and the reference signal to provide data points that may, for ease of explanation, be graphically visualized as difference (y-axis) vs. time (x-axis). (The calculation may, of course, be done using other statistical analysis methods as well.) The computer then calculates a trigger time by calculating the slope between the graphed comparison data points, and then fitting a best-fit line to the data points, and extrapolating the best-fit line to cross the time axis resulting in a time intercept, which is the trigger time. Then, a preset constant value is added to the time intercept (trigger time) resulting in an endpoint time. At the endpoint time or at a given time established as a known completion time, if the endpoint time has not occurred, the polishing process is terminated.

Optical endpoint detection is accomplished by comparing a gathered reflectance spectrum to a reference spectrum. The reference spectrum is obtained by polishing a reference wafer to a process of record (POR) polish time and using the POR conditions while collecting the reflectance spectra at time intervals from the wafer. A reflectance spectrum from a selected time period just prior to the completion of polishing is then designated as the reference spectrum. One or more wafers may be used to establish the reference spectrum.

For wafers with a metal film to be polished, the reference signal and corresponding reference spectrum are typically selected at a time that corresponds to stable polishing of the metal film before the onset of clearing the metal film occurs. When clearing occurs, the reflected spectrum is substantially different from the reference spectrum taken during the metal phase. Since the metal film reflectance spectrum is similar from wafer to wafer, the reference spectrum may be taken from a reference wafer, or it may be taken each time a wafer is polished from the wafer itself, during the bulk metal polishing phase before any clearing takes place.

If it is desired to generate an endpoint on a barrier film between the metal film and a dielectric layer, the reference spectrum may be taken from the barrier layer of the appropriate reference wafer.

For dielectric film wafers, where the film reflectance changes during polishing, it is preferred to take a reference spectrum near the desired end point from a reference wafer. If it is desirable to know when, for example, half of the dielectric layer has been removed, a reference spectrum should be taken from the reference wafer that corresponds to half of the film being removed. The selection of the reference spectrum corresponds to the desired information from the film being polished.

Production wafers are then polished and the reflectance spectrum is continuously sampled at the selected time intervals. A comparison is made between the reference spectrum and the reflectance spectrum sometime before a point in time when the process would be known to be completed. Data generated from the comparison, if visualized as graphed over time, would indicate a convergence as the sampled signals gathered became closer in magnitude. A best-fit line is then determined for the endpoint signal data generated from the comparison, and the line is extrapolated to the x-axis to determine a trigger time. A predetermined amount of time is then added to the trigger time to produce an endpoint time. When the endpoint time is reached the polishing process ends. The polishing process may also end if a time predicted exceeds an acceptable value such as the total time required to polish the reference wafer.

This Summary of the Invention section is intended to introduce the reader to aspects of the invention and is not a complete description of the invention. Particular aspects of the invention are pointed out in other sections here below and the invention is set forth in the appended claims, which alone demarcate its scope.

BRIEF DESCRIPTION OF THE DRAWINGS

The foregoing embodiments and many of the attendant advantages of this invention will become more readily appreciated by reference to the following detailed description, when taken in conjunction with the accompanying illustrative drawings that are not necessarily to scale, wherein.

DETAILED DESCRIPTION

Figure 1:
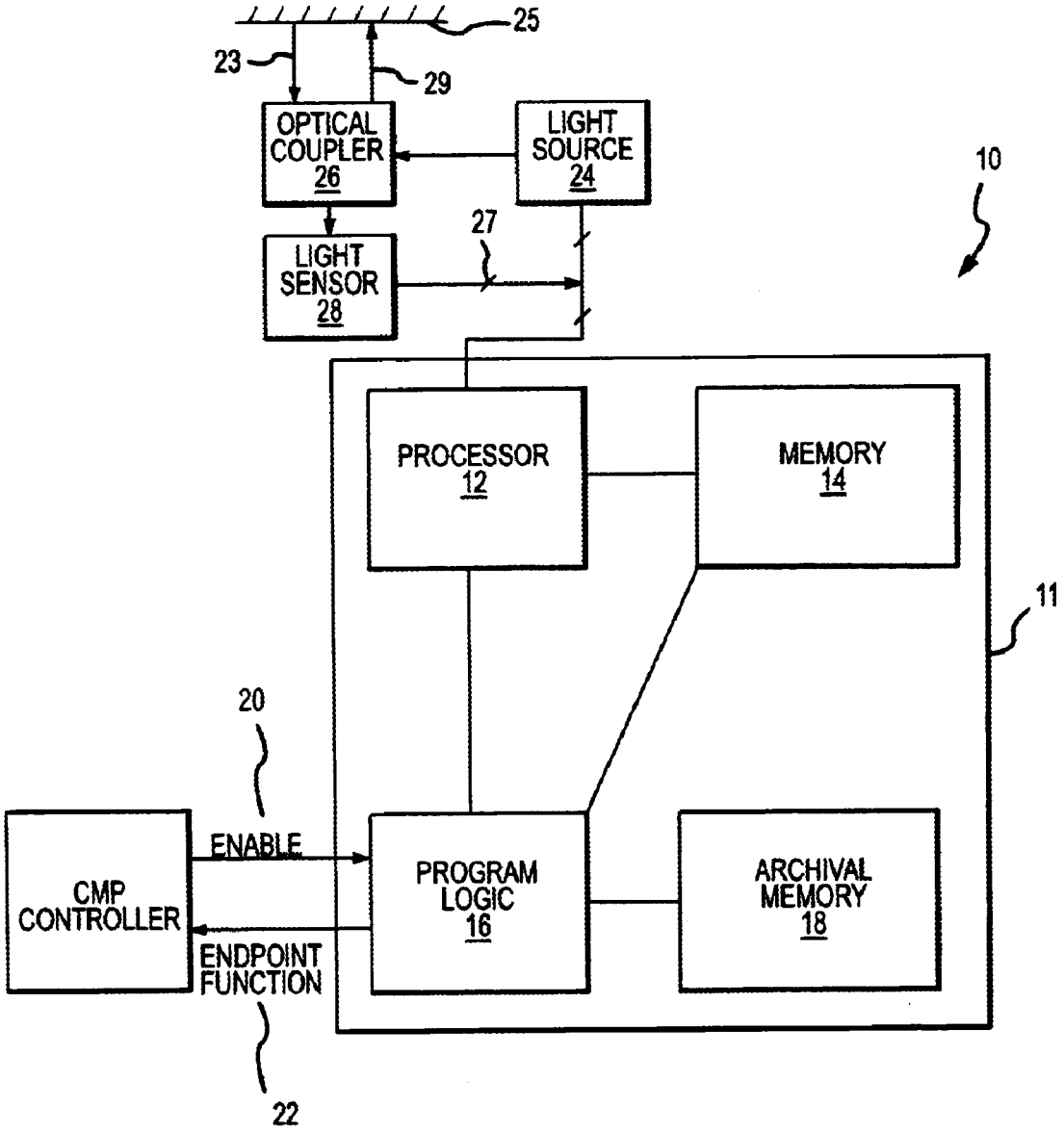
FIG. 1 is a schematic representation of one embodiment of the present invention.

The present invention relates to a method of optical endpoint detection (EPD) in chemical mechanical planarization (CMP), and specifically to a method of processing the optical data and predicting an endpoint time. The invention predicts an endpoint even with sparse data. FIG. 1 illustrates one embodiment of the CMP endpoint predictive system 10 in accordance with the invention.

A processor 12 is in communication with program logic 16. Program logic 16 directs the processor 12, which is in communication with an incident light source 24 to propagate a waveform upon receiving an enable signal 20. The incident light source 24 is in communication with an optical coupler 26, which allows a waveform 29 to advance to a surface 25. Surface 25 reflects waveform 23 back to the optical coupler 26. There are several reflection processes used throughout the industry to propagate and collect reflection data and one embodiment is detailed in FIG. 3 herein below. The optical coupler 26 additionally is in communication with a light sensor 28 and relays the reflected waveform to the light sensor 28. After a specified or predetermined integration time by the light sensor 28, the reflected spectral data 27 is read out of the light sensor 28 and transmitted to the processor 12. The light sensor 28 provides reflective spectral data 27 to the processor 12 in digital form. Processor 12 can be implemented as a microprocessor, a programmable logic controller (PLC), or any other type of programmable logic device (PLD). Program logic 16 can be located in either volatile or non-volatile memory that may include but is not limited to random access memory (RAM), read only memory (ROM), programmable read only memory (PROM), erasable programmable read only memory (EPROM), or any other type of memory which would allow the program logic to function properly. The light sensor 28 can be of any type, which would produce a digital data spectrum based on optical input. Examples include, but are not limited to the S2000 and PC2000 from Ocean Optics located in El Dorado Hills, Calif.; the "F" series of products from Filmetrics Inc. of San Diego, Calif.; or the like.

The processor 12 additionally is in communication with memory 14 and program logic 16 directs the processor 12 to store the reflected spectral data in the memory 14. Memory 14 is in communication with program logic 16, which acquires the reflected spectral data from the memory 14. Program logic 16 is also in communication with archived memory 18, which contains reference spectral data. Program logic 16 then acquires the reference spectral data from archived memory 18 and implements a program to compare the spectral data of the reflected and reference waveforms. When predetermined conditions are met, the program logic 16 signals the endpoint function 22.

The program conducts a comparison, which generates a "difference" between the reference signal and the reflectance signals during polishing. One method of finding a difference is to calculate the sum of the square of the difference between the reflectance from the reference spectrum and the reflected spectrum for each point in the corresponding spectra (see EQUATION 1):

$$S(t)=\Sigma_i[R(\lambda_i, t)-R_{ref}(\lambda_i, t_{ref})]^2 \quad 1)$$

Figure 2:
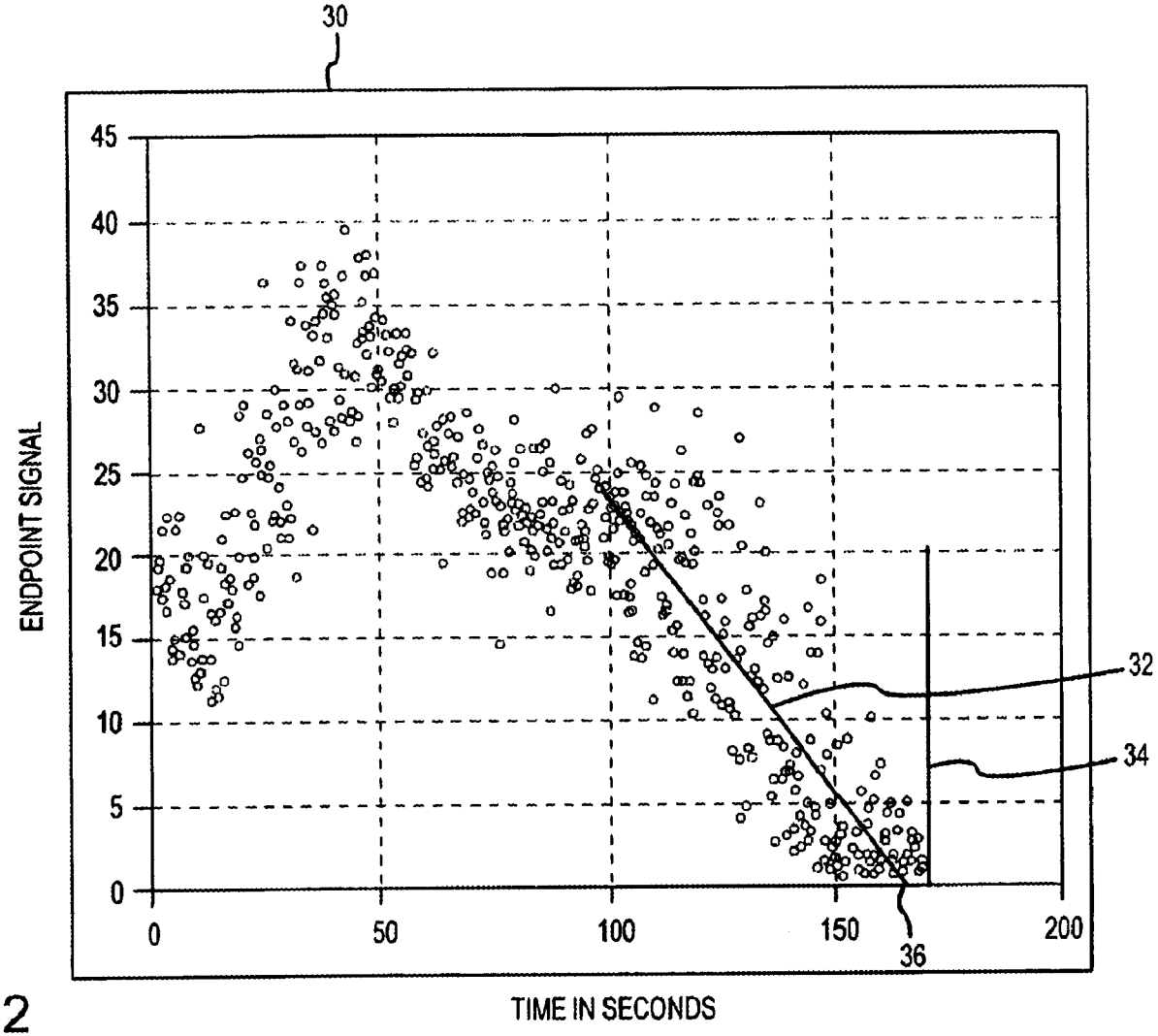
FIG. 2 illustrates a graph of sampled data versus time to project an endpoint.

In the above equation, S(t) is the end point signal as a function of polish time, $R(\lambda_i,t)$ is the measured reflectance spectrum at polish time t, and $R(\lambda_i,t_{ref})$ is the reference spectrum. The end point signal data (y-axis) can be plotted against polish time (x-axis), as illustrated in FIG. 2 (an example), to illustrate the convergence of the data. The program fits a subset of the individual data points in the endpoint signal to a line 32. The time corresponding to the x-intercept is then defined as the endpoint "trigger" 36. A predetermined amount of time is then added to the trigger time to produce an "endpoint time" 34. This predetermined amount of time is determined from consideration of any of a number of factors such as the history of a particular integrated circuit design, and may include factors such as pad wear, variations in slurry flow, etc. It should be noted that while FIG. 2 provides a visual illustration that a program may output to some type of output device (for example, a monitor), the computer can implement the program internally unto itself. FIG. 2 is provided for clarity and to assist one having skill in the art in utilizing this program or another program, such as, for example, regression analysis, analysis of variance (ANAVAR) or statistical curve fitting techniques, that would result in a similar outcome.

Under some circumstances, e.g. The presence of gaseous bubbles in the slurry, noise in the system may present challenges in the data collection process. Additional signal conditioning may be used to reduce the noise of the system. Such conditioning includes smoothing the spectra in wavelength or energy and smoothing the endpoint signal over time. In one implementation, the program logic 16 requires that the comparison test be valid for n-times sequentially before end-point is declared where n is user selectable, e.g. 5. Another technique is to normalize the total integrated measured spectrum to a standard value and the reference spectrum to the same value before calculation of the endpoint takes place.

Another practice is to delay the calculation of the endpoint signal until a given start time after the onset of the polishing process. This delay allows the polishing process to remove uncontrolled surface material (e.g. any of various copper oxides that can form on copper films), thus stabilizing the resulting reflectance signal. This approach is particularly useful when polishing a metal film, such as copper, before the comparison to threshold value is made. Thus, a 20 to 30 second delay benefits copper endpoint detection, for example, while a greater or lesser amount of delay may be of benefit to other semiconductor wafer materials. A delay can also prove beneficial in the polishing of transparent sheet films or transparent films on patterned wafers to minimize order skipping, as the signal from the light reflected from a transparent film stack is repetitive as thickness changes if a relatively narrow bandwidth optical source is used. In another example, a delay of approximately 45 seconds is useful when polishing shallow trench isolation (STI) wafers. One skilled in the art can use other signal processing and conditioning techniques and combinations thereof to further enhance the signal and reliability.

Additionally, the calculation that determines the difference between the reference spectrum and the measured spectra may be formulated in a variety of other ways. For example, the exponent in EQUATION 1 can be a different power instead of 2, the measured spectrum may be divided by the reference spectrum and squared or left as a signed vector, or a moment in spectrum space may be calculated for each reference spectrum and measured spectrum and the moments subtracted. Again, a person having skill in the art can use these or other acceptable methods for calculating the differences between the spectra.

In one actual embodiment and referring to FIG. 2, a STI patterned wafer with an oxide film is introduced to the polishing method. The program begins to process data the system has collected after 100 seconds, based on experience with this wafer type. Beginning at approximately 60% of expected endpoint time until approximately 94% of expected endpoint time, the line fit slope and y-axis intercept recorded data are collected and then averaged utilizing the method of EQUATION 1 and/or one of the other methods described above. If the thickness of the oxide film is less than 1500 angstroms the program may begin collecting data at 30% of expected endpoint time due to data patterns in the oxide layer not repeating prior to the film beginning to clear. Similarly, if a metal layer is exposed to the process, data collection might begin at 30% of expected endpoint time. However, if the reference data collected were collected after the reference metal had began to clear, the data collection might be limited to beginning at 85%–95% of expected endpoint time.

Operating margins are determined in large part by the film stack being polished and the process conditions, in particular the material removal rate. Slowing the polish process down in this embodiment may result in reducing the point of data collection from 60% to, e.g. 50% or less. Unfortunately, reducing the removal rate results in a corresponding decrease in throughput, which increases costs. Therefore, preferable operations are conducted with process conditions that provide the fastest polish time consistent with acceptable process results. The 94% of expected completion time point to stop data collection is used in this embodiment to leave sufficient time to allow the processor to perform validation checks and for the CMP system to have sufficient time to activate a response to the endpoint signal. Typically, several seconds are needed, but that time, too, depends on factors such as operating conditions and the specific tool being used. For example, a point to consider is how long a particular tool takes to reduce a nominal polishing rate to essentially zero.

The resulting data is then used to fit a line to the data 32. The Time-axis (x-axis) intercept is then defined as the trigger time 36, also referred to as LineFit Trigger in the industry. A predetermined amount of time, depending on experience, or alternatively a predetermined percentage of the LineFit Trigger time, is then added to the LineFit Trigger time to obtain the endpoint time 34, also referred to as EndPoint Trigger in the industry.

The present invention potentially allows one to use a single procedure to predict the endpoint for a variety of CMP applications. The invention works on a broader range of wafers than previously disclosed methods including STI, tungsten (W), copper (Cu), and inter-level dielectric (ILD) wafers. In practice this invention can be used for process quality checks as well. The invention is less susceptible to noise than other previous methods and it is more immune to sparse data and signal drift. The present invention also provides for correction and compensation of the EndPoint Trigger for drifts in the baseline of the endpoint signal by making use of more data and normalizing the data used.

The present invention may be practiced with any data collection system on any type of polisher, such as rotary, orbital, linear, or other motion CMP systems. Additionally, it may be practiced with any optical system that returns a reflectance measurement at more than one wavelength. While two wavelengths would work, typical broadband illumination and detection is preferred. Such illumination between 200 nm and 1000 nm would suffice, with 400 nm to 850 nm being preferred. This method works with all known semiconductor wafer films and filmstacks. Clearing of metal layers and the thinning and planarization of transparent film stacks on both sheet film and patterned wafers is possible with the present invention. Additionally, endpoint detection, when polishing a homogeneous wafer, can be accomplished with the present invention provided the target thickness is sufficiently thin, for example, tens of microns. However, even greater thickness can be polished using this method if longer wavelength light is used.

The present invention can be used in a wide variety of CMP tools, including but not limited to orbital polishers, for example, U.S. Pat. No. 6,106,662 entitled "Method and Apparatus for Endpoint Detection for Chemical Mechanical Polishing," discloses an orbital chemical-mechanical polishing apparatus, and is hereby incorporated by reference to the extent pertinent.

Figure 3:
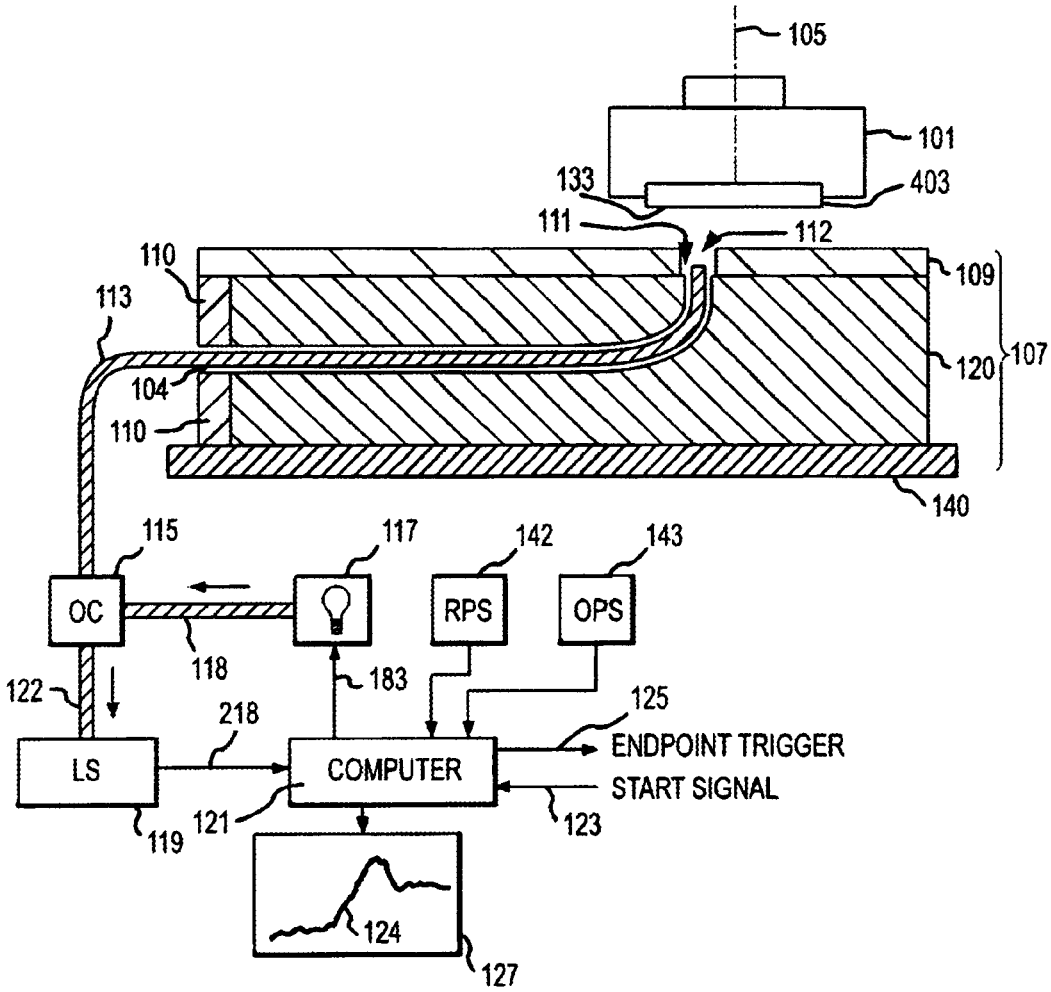
FIG. 3 is a schematic representation of a preferred embodiment of the present invention.

This type of CMP apparatus is shown in FIG. 3 and is a preferred embodiment for collecting data to implement the present invention. CMP machines typically include a structure for holding a wafer or substrate to be polished. Such a holding structure is sometimes referred to as a carrier, but the holding structure of the present invention is referred to herein as a "wafer chuck". CMP machines also typically include a polishing pad and a way to support the pad. Such pad support is sometimes referred to as a polishing table or platen, but the pad support of the present invention is referred to herein as a "pad backer". Slurry is required for polishing and is delivered either directly to the surface of the pad or through-holes and grooves in the pad directly to the surface of the wafer. The control system of the CMP machine causes the surface of the wafer to be pressed against the pad surface. The motion of the wafer relative to the pad depends on the type of machine.

Further, as described below, the motion of the polishing pad is nonrotational in one embodiment to enable a short length of fiber optic cable to be inserted into the pad without need for an optical rotational coupler. Instead of being rotational, the motion of the pad is "orbital" in a preferred embodiment. In other words, each point on the pad undergoes circular motion about its individual axis, which is parallel to the wafer chuck's axis. In one embodiment, the orbit diameter is 1.25 inches although other diameters are also useful. Further, it is to be understood that other elements of the CMP tool not specifically shown or described may take various forms known to person of ordinary skill in the art. For example, the present invention can be adapted for use in the CMP tool disclosed in the U.S. Pat. No. 5,554,064, which is incorporated herein by reference to the extent relevant.

A schematic representation of the overall system of data collection for the present invention is shown in FIG. 3. As seen, a wafer chuck 101 holds a wafer 103 having a surface 133 that is to be polished. The wafer chuck 101 preferably rotates about its vertical axis 105. A pad assembly 107 includes a polishing pad 109 mounted onto a pad backer 120. The pad backer 120 is in turn mounted onto a pad backing plate 140. In one embodiment, the pad backer 120 is manufactured from urethane and the pad backing plate 140 is stainless steel. Other embodiments may use other suitable materials for the pad backer and pad backing. Further, the pad backing plate 140 is secured to a driver or motor means (not shown) that is operative to move the pad assembly 107 in orbital motion in this embodiment.

Polishing pad 109 includes a through-hole 112 that registers with a pinhole opening 111 in the pad backer 120. Further, a canal 104 is formed in the pad backer 120 (for example, in a middle region), the pad backer 120 being adjacent to the backing plate 140. The canal 104 leads from an exterior edge 110 of the pad backer 120 to the pinhole opening 111. In one embodiment, a fiber optic cable assembly including a fiber optic cable 113 is inserted in the pad backer 120 of pad assembly 107, with one end of fiber optic cable 113 extending through the top surface of pad backer 120 and partially into through-hole 112. Fiber optic cable 113 can be embedded in pad backer 120 so as to form a watertight seal with the pad backer 120, but a watertight seal is not necessary to practice the invention. Further, in contrast to conventional systems as exemplified by Lustig et al. that use a platen with a window of quartz or urethane, the present data collection technique does not include such a window. Rather, the pinhole opening 111 is merely an orifice in the pad backer in which fiber optic cable 113 may be placed. Thus, in the present invention, the fiber optic cable 113 is not sealed to the pad backer 120. Moreover, because of the use of a pinhole opening 111, the fiber optic cable 113 may even be placed within one of the existing holes in the pad backer and polishing pad used for the delivery of slurry without adversely affecting the CMP process. As an additional difference, the polishing pad 109 has a simple through-hole 112.

Fiber optic cable 113 leads from through-hole 112 to an optical coupler 115 that receives light from a light source 117 via a fiber optic cable 118 and directs light from the light source 117 to the surface 133 of wafer 103. The optical coupler 115 also propagates the reflected light signal from surface 133 of wafer 103 to a light sensor 119 via fiber optic cable 122. The reflected light signal is generated in accordance with the present invention, as described below.

A computer 121 is in communication with light source 117 and provides a control signal 183 to light source 117 that directs the emission of light from the light source 117. The light source 117 is a broadband light source, preferably with a spectrum of light between 200 and 1000 nm in wavelength, and more preferably with a spectrum of light between 400 and 900 nm in wavelength. A tungsten bulb is suitable for use as the light source 117. Computer 121 also receives a start signal 123 that activates the light source 117 and the EPD methodology. The computer 121 also provides an endpoint trigger 125 when, through the analysis of the present invention, it is determined that the endpoint of the polishing has been reached.

Orbital position sensor 143 provides the orbital position of the pad assembly while the wafer chuck's rotary position sensor 142 provides the angular position of the wafer chuck to the computer 121, respectively. Computer 121 can synchronize the trigger of the data collection to the positional information from the sensors. The orbital sensor identifies which radius the data is coming from and the combination of the orbital sensor and the rotary sensor determine which point.

In operation, soon after the CMP process has begun, the start signal 123 is provided to the computer 121 to initiate the monitoring process. Computer 121 then directs light source 117 to transmit light from light source 117 via fiber optic cable 118 to optical coupler 115. This light in turn is routed through fiber optic cable 113 to be incident on the surface of the wafer 103 through pinhole opening 111 and the through-hole 112 in the polishing pad 109.

Reflected light from the surface 133 of the wafer 103 is captured by the fiber optic cable 113 and routed back to the optical coupler 115. Although in one embodiment the reflected light is relayed using the fiber optic cable 113, it will be appreciated that a separate dedicated fiber optic cable (not shown) may be used to collect the reflected light. The return fiber optic cable would then preferably share the canal 104 with the fiber optic cable 113 in a single fiber optic cable assembly.

The optical coupler 115 relays this reflected light signal through fiber optic cable 122 to light sensor 119. Light sensor 119 includes a detector array, and is operative to provide reflected spectral data in digital form of the reflected light to computer 121. The computer 121 depicted in FIG. 3 is detailed and its function described in the FIG. 1 above.

One advantage provided by the optical coupler 115 is that rapid replacement of the pad assembly 107 is possible while retaining the capability of endpoint detection on subsequent wafers. Additionally, positioning coupler relatively near the pad backer, as opposed to being near the light sensor and/or other equipment, facilitates the ease of operation of the system. In other words, the fiber optic cable 113 may simply be detached from the optical coupler 115 and a new pad assembly 107 may be installed (complete with a new fiber optic cable 113). For example, this feature is advantageously utilized in replacing used polishing pads in the polisher. A spare pad backer assembly having a fresh polishing pad is used to replace the pad backer assembly in the polisher. The used polishing pad from the removed pad backer assembly is then replaced with a fresh polishing pad for subsequent use.

After a specified or predetermined integration time by the light sensor 119, the reflected spectral data 218 is read out of the detector array and transmitted to the computer 121. The integration time typically ranges from 5 to 150 ms, with the integration time being 15 ms in a preferred embodiment. The computer 121 is then directed to practice the invention as is detailed above in the FIGS. 1 and 2 discussions.

In the preceding description and discussion the term wafer is meant to include all workpieces that are related to electronics, such as bare wafers with films, wafers partially or fully processed for forming integrated circuits and interconnecting lines, wafers partially or fully processed for forming micro-electro-mechanical devices (MEMS), specialized circuit assembly substrates, circuit boards, hybrid circuits, hard disk platters, flat panel display substrates, or other structures that would benefit from CMP with end point detection. Additionally, in the preceding description and discussion the term surface of a wafer includes but is not limited to films including a metallic layer such as aluminum, copper, tungsten, and the like, an insulating layer such as glass, ceramics, and the like, or any other material layer which is commonly used in semiconductor processing and may benefit from this process.

The foregoing description provides an enabling disclosure of the invention, which is not limited by the description but only by the scope of the appended claims. All those other aspects of the invention that will become apparent to a person of skill in the art, who has read the foregoing, are within the scope of the invention and of the claims herebelow.

We claim:

1. A method for determining an endpoint during polishing of a semiconductor wafer, the method comprising:

sampling the wafer surface at time intervals to determine reflectance spectra at each time interval;

calculating a magnitude of a difference between a reflectance spectrum and a reference spectrum for each sampled time interval;

using paired data comprising the calculated magnitude and corresponding time interval to determine a best straight line curve fit;

determining a trigger time value when the magnitude difference is zero, based on the best curve fit; and the trigger time is based on extrapolating the straight line fit to zero; an endpoint time is determined by adding an over-polish time; and determining a wafer polishing endpoint time based on the trigger time.

2. The method of claim 1 wherein the comparing step comprises calculating the sum of the squares of the differences between the reflected spectrum data and the reference spectrum data.

3. The method of claim 1, wherein the step of predicting the endpoint time comprises:

calculating a sum of the trigger time and a predetermined amount of time, wherein the predetermined amount of time is a constant.

4. The method of claim 1, wherein the step of predicting the endpoint time comprises:

calculating a sum of the trigger time and a predetermined amount of time, wherein the predetermined amount of time is a percentage of the trigger time.

5. The method of claim 1, wherein the step of collecting data samples is performed after a predetermined time delay, wherein the predetermined time delay is less than an expected total polish time.

6. An apparatus to generate an endpoint in the polishing of films on a semiconductor wafer for use in a chemical mechanical polishing system comprising:

a light source providing light to reflect from a film;

a light sensor receiving a spectrum of light reflected from the film, the light sensor including a processor generating, in digital form, spectral reflective data based on the reflected spectrum of light; and a computer in communication with the light sensor receiving the generated data, the computer programmed to generate an endpoint based on the generated data, wherein the generation of the endpoint comprises:

calculating a trigger time based upon the collected data which comprises the steps of:

sampling the wafer surface at time intervals to determine reflectance spectra at each time interval;

calculating a magnitude of a difference between a reflectance spectrum and a reference spectrum for each sampled time interval;

using paired data comprising calculated magnitudes and corresponding time intervals to determine a best straight line curve fit; and determining a trigger time value when the magnitude difference is zero, based on the best curve fit; and determining the wafer polishing endpoint time based on the trigger time.

7. A method for detecting an endpoint during chemical mechanical polishing of a wafer surface of a wafer, the method comprising:

producing reference spectrum data corresponding to a spectrum of light reflected from a surface of a reference wafer at least at a time proximate to an estimated endpoint of the polishing;

producing reflectance spectrum data corresponding to a spectrum of light reflected from a surface of a production wafer at least at a time proximate to an expected endpoint;

comparing the reflected spectrum data with the reference spectrum data by calculating the sum of the squares of the differences between the reflected spectrum data and the reference spectrum data;

calculating a trigger time based upon a statistical analysis of the data collected; and determining the endpoint time based on the trigger time.

8. The method of claim 7, wherein the step of calculating the trigger time comprises:

using paired data comprising calculated magnitudes and corresponding time intervals to determine a best straight line curve fit; and determining a trigger time value when the magnitude difference is zero, based on the best curve fit.

* * * * *